US008517115B2

(12) United States Patent
Watson

(10) Patent No.: US 8,517,115 B2
(45) Date of Patent: Aug. 27, 2013

(54) SETTING TOOL

(75) Inventor: Brock Watson, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 289 days.

(21) Appl. No.: 13/014,705

(22) Filed: Jan. 26, 2011

(65) Prior Publication Data

US 2012/0186829 A1 Jul. 26, 2012

(51) Int. Cl.
*E21B 23/00* (2006.01)

(52) U.S. Cl.
USPC ..... 166/382; 166/208; 166/212; 166/380

(58) Field of Classification Search
USPC ..... 166/207, 208, 212, 122, 187, 382, 166/380
See application file for complete search history.

(56) References Cited

U.S. PATENT DOCUMENTS

| | | | | |
|---|---|---|---|---|
| 5,170,844 | A | 12/1992 | George et al. | |
| 5,437,330 | A | 8/1995 | Gambertoglio | |
| 5,553,672 | A | 9/1996 | Smith, Jr. et al. | |
| 6,834,726 | B2 * | 12/2004 | Giroux et al. | 166/386 |
| 7,562,712 | B2 | 7/2009 | Cho et al. | |
| 2002/0070032 | A1 | 6/2002 | Maguire et al. | |
| 2008/0041597 | A1 * | 2/2008 | Fisher et al. | 166/381 |
| 2009/0107686 | A1 | 4/2009 | Watson | |

OTHER PUBLICATIONS

Foreign Communication From a Related Counterpart Application—International Search Report and Written Opinion, PCT/US2012/022586, Jul. 25, 2012.

* cited by examiner

*Primary Examiner* — Giovanna Wright

(57) ABSTRACT

A downhole setting tool is provided. The tool comprises a tool housing and a hollow mandrel, the mandrel being situated in the housing. The tool further comprises a piston situated between the mandrel and the tool housing and a collar situated between the mandrel and the tool housing, wherein the tool housing, the mandrel, the piston and the collar define an annulus. The tool further comprises a first valve, wherein in a closed position the first valve blocks a path of fluid communication between the interior of the mandrel and the annulus.

20 Claims, 12 Drawing Sheets

SETTING TOOL

CROSS-REFERENCE TO RELATED APPLICATIONS

Not Applicable.

STATEMENT REGARDING FEDERALLY SPONSORED RESEARCH OR DEVELOPMENT

Not applicable.

REFERENCE TO A MICROFICHE APPENDIX

Not applicable.

BACKGROUND OF THE INVENTION

Expandable liner hangers are generally used to secure a liner within a previously set casing or liner string. These types of liner hangers are typically set by expanding the liner hangers radially outward into gripping and sealing contact with the previous casing or liner string. Many such liner hangers are expanded by use of hydraulic pressure to drive an expanding cone or wedge through the liner hanger.

The expansion process is typically performed by means of a running tool or setting tool used to convey the liner hanger and attached liner into a wellbore. The running tool or setting tool may be interconnected between a work string (e.g., a tubular string made up of drill pipe or other segmented or continuous tubular elements) and the liner hanger.

If the liner hanger is expanded using hydraulic pressure, then the running tool or setting tool is generally used to control the communication of fluid pressure, and flow to and from various portions of the liner hanger expansion mechanism, and between the work string and the liner. The running tool or setting tool may also be used to control when and how the work string is released from the liner hanger, for example, after expansion of the liner hanger, in emergency situations, or after an unsuccessful setting of the liner hanger.

The running tool or setting tool is also usually expected to provide for cementing therethrough, in those cases in which the liner is to be cemented in the wellbore. Some designs of the running or setting tool require a ball or cementing plug to be dropped through the work string at the completion of the cementing operation and prior to expanding the liner hanger.

In running tools or setting tools that expand a liner hanger using hydraulic pressure, multiple stacked pistons may be employed to apply force to an expanding cone or wedge to drive it through the liner hanger. The force required to expand the liner hanger may vary widely due to factors such as friction, casing tolerance and piston sizing. In addition, the pistons may be exposed to internal pressure in the tool during cementing of the liner and/or release of a cementing plug and/or circulation of drilling fluids through the liner and the wellbore, thereby risking premature expansion of the liner hanger. Accordingly, hydraulic pressures in the tool must be carefully monitored during activities undertaken prior to expanding the liner hanger.

SUMMARY OF THE INVENTION

In an embodiment, a downhole setting tool is disclosed. The tool comprises a tool housing and a hollow mandrel, the mandrel being situated in the housing. The tool further comprises a piston situated between the mandrel and the tool housing and a collar situated between the mandrel and the tool housing, wherein the tool housing, the mandrel, the piston and the collar define an annulus. The tool further comprises a first valve, wherein in a closed position the first valve blocks a path of fluid communication between the interior of the mandrel and the annulus.

In an embodiment, a downhole setting tool is provided. The tool comprises a tool housing, a hollow mandrel having at least one transverse hole that runs from an interior of the mandrel to an exterior of the mandrel, the mandrel being situated in the housing, and a piston situated between the mandrel and the tool housing. The tool further comprises a collar situated between the mandrel and the tool housing, wherein the tool housing, the mandrel, the piston and the collar define an annulus. The tool further comprises a vent hole situated in the collar, the vent hole forming a path of fluid communication between the annulus and a second annulus partially defined by the collar and the tool housing.

In an embodiment, a method of setting a liner hanger in a wellbore using a downhole setting tool is disclosed. The method comprises providing a downhole setting tool comprising a tool housing, a mandrel, a piston, and a collar, wherein the piston and the collar define a first annulus, and wherein the tool housing, the mandrel, and the collar partially define a second annulus. The method further comprises placing the downhole setting tool into the wellbore, the interior of the mandrel and the second annulus being subjected to an ambient wellbore pressure as the downhole setting tool is placed into the wellbore. The method further comprises adjusting a pressure in the first annulus to approximately the ambient wellbore pressure by bleeding fluid from the second annulus into the first annulus via a first valve situated in the collar, between the first annulus and the second annulus. The method further comprises pressurizing the interior of the mandrel to a pressure greater than the ambient wellbore pressure. The method further comprises opening a second valve situated between an interior of the mandrel and the first annulus, forcing a portion of a fluid situated in the mandrel into the first annulus, and forcing the piston in a downhole direction with respect to the mandrel.

These and other features will be more clearly understood from the following detailed description taken in conjunction with the accompanying drawings and claims.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION OF THE EMBODIMENTS

Figure 1A:
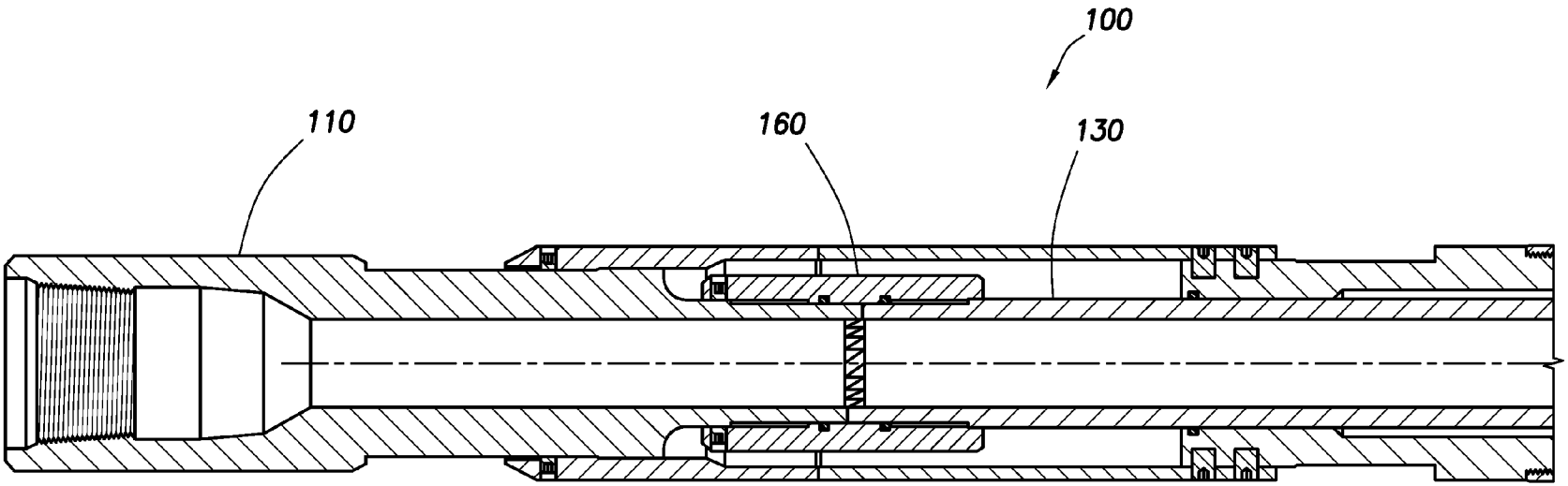
FIG. 1*a* is a schematic cross-sectional view of a portion of an embodiment of a setting tool.

It should be understood at the outset that although illustrative implementations of one or more embodiments are illustrated below, the disclosed assemblies and methods may be implemented using any number of techniques, whether currently known or not yet in existence. The disclosure should in no way be limited to the illustrative implementations, drawings, and techniques illustrated below, but may be modified within the scope of the appended claims along with their full scope of equivalents.

Unless otherwise specified, any use of the term "couple" describing an interaction between elements is not meant to limit the interaction to direct interaction between the elements and may also include indirect interaction between the elements described. In the following discussion and in the claims, the terms "including" and "comprising" are used in an open-ended fashion, and thus should be interpreted to mean "including, but not limited to . . . ". Reference to up or down will be made for purposes of description with "up," "upper," "upward," "upstream" or "uphole" meaning toward the surface of the wellbore and with "down," "lower," "downward," "downstream" or "downhole" meaning toward the terminal end of the well, regardless of the wellbore orientation. The various characteristics mentioned above, as well as other features and characteristics described in more detail below, will be readily apparent to those skilled in the art with the aid of this disclosure upon reading the following detailed description of the embodiments, and by referring to the accompanying drawings.

In an embodiment, a liner setting tool is provided which includes a hollow cylindrical tool housing coupled to liner hanger expansion cones; a hollow mandrel that is situated inside the tool housing and is configured to convey pressurized fluid through the setting tool; and one or more force multiplier pistons that are situated inside the tool housing, are rigidly attached to the tool housing and are configured to slide along the mandrel. When a liner hanger is to be expanded against a casing in a wellbore, pressurized fluid from the mandrel may be allowed into an annulus, i.e., a cylinder, bounded by the tool housing, the mandrel, the force multiplier piston and a coupling rigidly attached to the mandrel. Upon exposure to the pressurized fluid, the cylinder and the tool housing are forced downhole relative to the mandrel. Simultaneously, the expansion cones, which are attached to the tool housing, are forced through the liner hanger and expand the liner hanger against the casing. Much of the functionality of the liner setting tool may be repurposed to other usage, for example in setting packers, by minor design modifications such as removing an expansion cone from the setting tool.

The above-described setting tool may be referred to as an annulus differential pressure operated tool, since during operation of the tool, at least a portion of an annulus situated between the tool housing and the mandrel is subjected to an ambient downhole pressure, whereas an interior of the mandrel is subjected to a higher fluid pressure generated by fluid pumps. One problem shared by known annulus differential pressure operated tools, in which hydraulic force is applied to force multiplier pistons for the purpose of driving expansion cones through a liner hanger, is that the pistons are in constant fluid communication with the interior of the mandrel and are thus always subjected to the pressure in the mandrel. Accordingly, when, e.g., a cementing plug is run through the mandrel, or cement is pumped through the mandrel for the purpose of cementing a liner to the wellbore, or wellbore servicing fluids are circulated through the mandrel, the pistons are subjected to forces that could possibly expand the liner hanger prematurely.

The setting tool disclosed in the present application responds to the above-mentioned problem of known annulus differential pressure operated tools by situating a valve between the interior of the mandrel and one or more of the pistons, which is configured to open only at a mandrel pressure significantly higher than mandrel pressures experienced during, e.g., release of a cementing plug, cementing of the liner, or circulation of wellbore servicing fluids. The valve may be, e.g., a rupture disk configured to fail at a setpoint mandrel pressure, or a piston-type valve having a piston held in place by a shear pin configured to fail when subjected to a force corresponding to a setpoint mandrel pressure. In this manner, the liner hanger may be prevented from expanding prematurely.

In addition, in order to prevent the portion of the tool housing surrounding the annulus bounded by the tool housing, the mandrel, the force multiplier piston and the coupling from collapsing when the setting tool is run into the wellbore and the tool housing is subjected to ambient downhole pressure, a second valve is situated in the coupling, between the annulus and a second annulus that is at the ambient downhole pressure. The second valve, e.g., a vent hole, a velocity valve or a spring-loaded check valve allows pressurized fluid from the second annulus to bleed into the annulus when a pressure differential develops between the second annulus and the first annulus. Accordingly, the second valve prevents the tool housing surrounding the annulus from collapsing under downhole conditions.

FIG. 1*a*, FIG. 1*b*, FIG. 1*c* and FIG. 1*d* are schematic cross-sectional views of portions of an embodiment of a setting tool 100 along a length of the setting tool 100. The setting tool 100 may be attached to a downhole end of a work string via an upper adapter 110 and may be used to attach a liner hanger 120 to a casing situated in a wellbore. In addition, the setting tool 100 may be used to convey cement that is pumped down the work string, down an interior of a liner attached to a downhole end of the setting tool 100, and up an annulus situated between the liner and a wall of a wellbore, for the purpose of cementing the liner to the wellbore. In order to be able to convey cement to the annulus and to expand the liner hanger 120, the setting tool 100 may comprise a series of mandrels 110, 130, 140, 150 which are interconnected and sealed by collars, e.g., couplings 160, 170, 180. As set forth above, the mandrel 110 may also be referred to as upper adapter 110 and may connect the setting tool 100 to the work string. In addition, a mandrel at a downhole end of the setting tool 100 may be referred to as a collet mandrel 190. The mandrels 110, 130, 140, 150, 190 are capable of holding and conveying a pressurized fluid, e.g., cement slurry, hydraulic fluid, etc.

In an embodiment, the setting tool 100 may further comprise pistons 200, 210 and respective pressure chambers or annuli 220, 230, which are in fluid communication with mandrels 140, 150 via at least one pressurization port 240, 250, respectively, and alternatively, via a plurality of pressurization ports 240, 250, respectively. In addition, the setting tool 100 may include expansion cones 270, which are situated downhole from the pistons 200, 210. As is apparent from FIG. 1*c*, the expansion cones 270 have an outer diameter greater than an inner diameter of a section of the liner hanger 120 downhole from the expansion cones 270.

In an embodiment, the liner hanger 120 may be expanded against a wall of the casing after the liner has been cemented to the wall of the wellbore. To expand the liner hanger 120, a hydraulic fluid may be pumped down the work string and into the mandrels 110, 130, 140, 150, 190 at a pressure that may range from 2500 psi to 10000 psi. The hydraulic fluid may enter the annuli 220, 230 via pressurization ports 240, 250 and exert a force on pistons 200, 210. The couplings 170, 180, which form uphole-side boundaries of the annuli 220, 230, are rigidly attached to mandrels 130, 140 and 140, 150, respectively, whereas pistons 200, 210 and expansion cones 270 are rigidly attached to a tool housing 280. In addition, the pistons 200, 210 and the expansion cones 270 may move longitudinally with respect to the mandrels 110, 130, 140, 150, 190. When a sufficient pressure has built up in the mandrels 110, 130, 140, 150, 190 and the annuli 220, 230, the pistons 200, 210, along with the tool housing 280 and the expansion cones 270, are forced downhole with respect to the mandrels 110, 130, 140, 150, 190. In an embodiment, the mandrel 130 and tool housing 280 may define an annulus 320. Since the outer diameter of the expansion cones 270 is greater than the inner diameter of the liner hanger 120 and the liner hanger 120 is longitudinally fixed in position in the wellbore, a portion of the liner hanger 120 in contact with the expansion cones 270 is expanded against the casing as the expansion cones 270 are forced downhole.

Figure 1B:
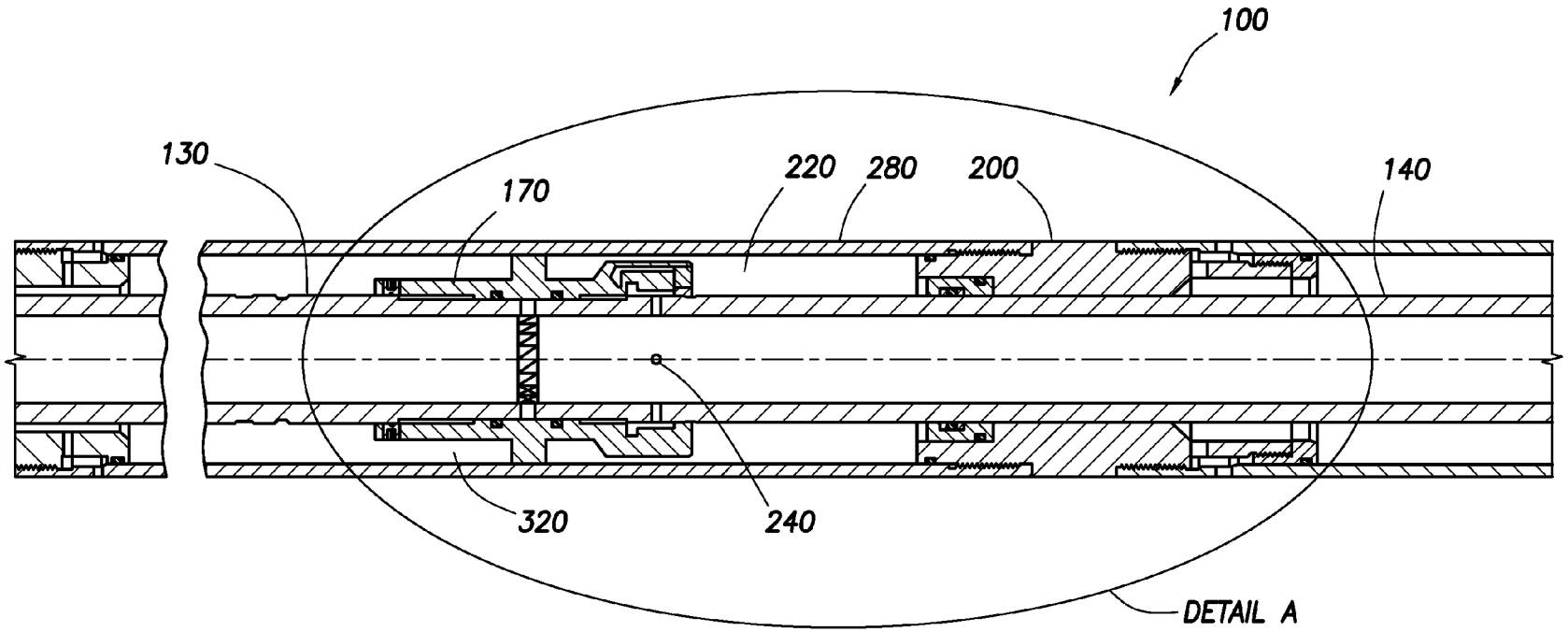
FIG. 1*b* is a schematic cross-sectional view of a further portion of the embodiment of a setting tool illustrated in FIG. 1*a*.
Figure 1C:
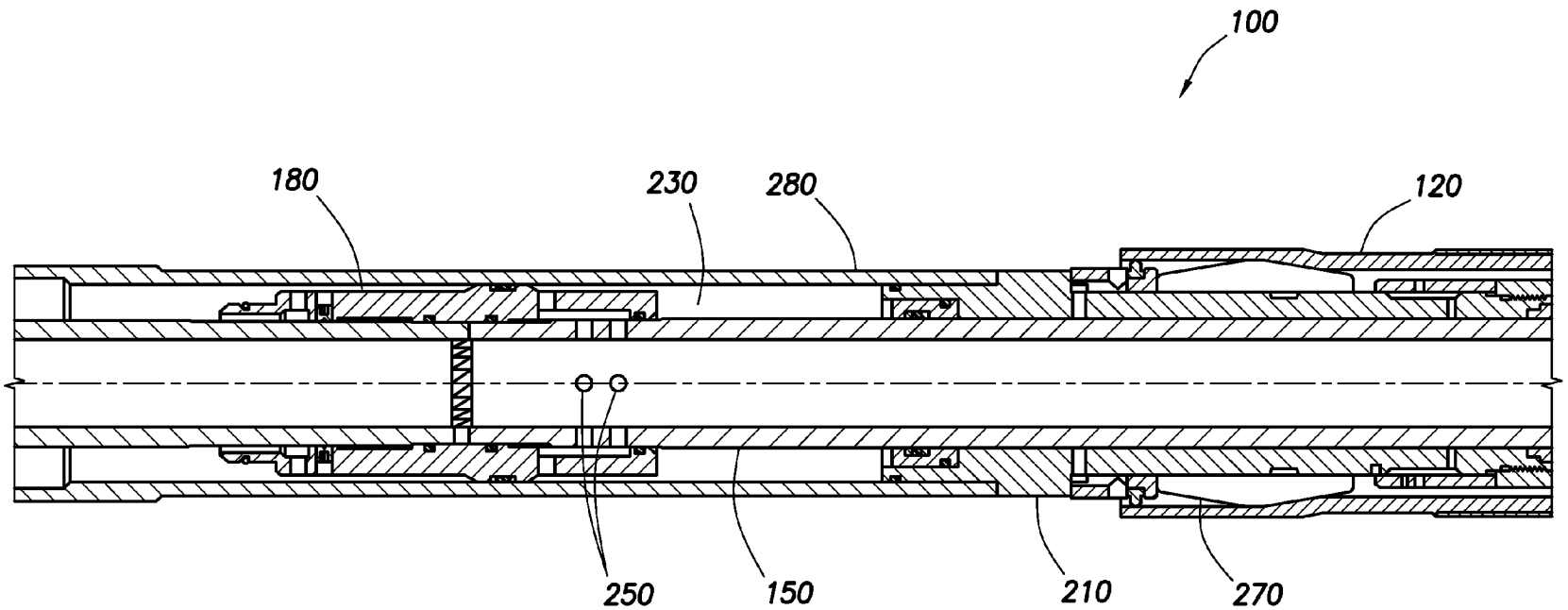
FIG. 1*c* is a schematic cross-sectional view of a further portion of the embodiment of a setting tool illustrated in FIG. 1*a*.
Figure 1D:
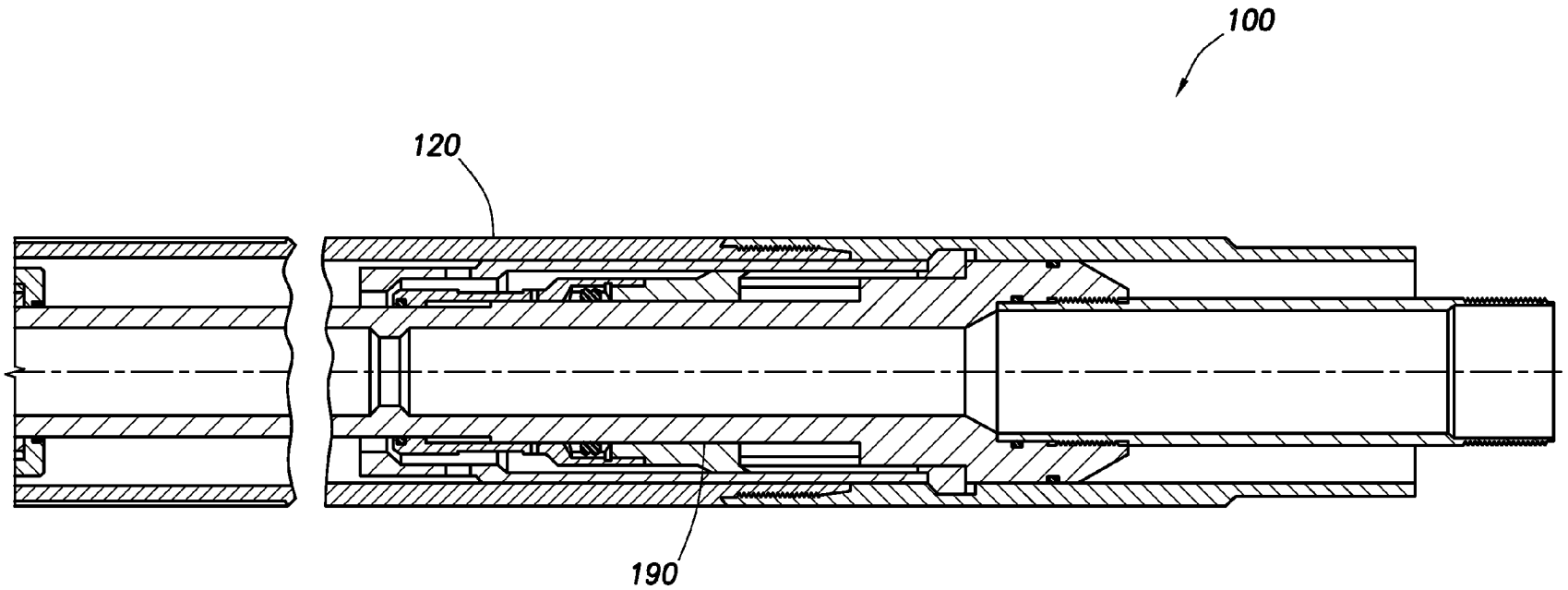
FIG. 1*d* is a schematic cross-sectional view of a further portion of the embodiment of a setting tool illustrated in FIG. 1*a*.
Figure 2:
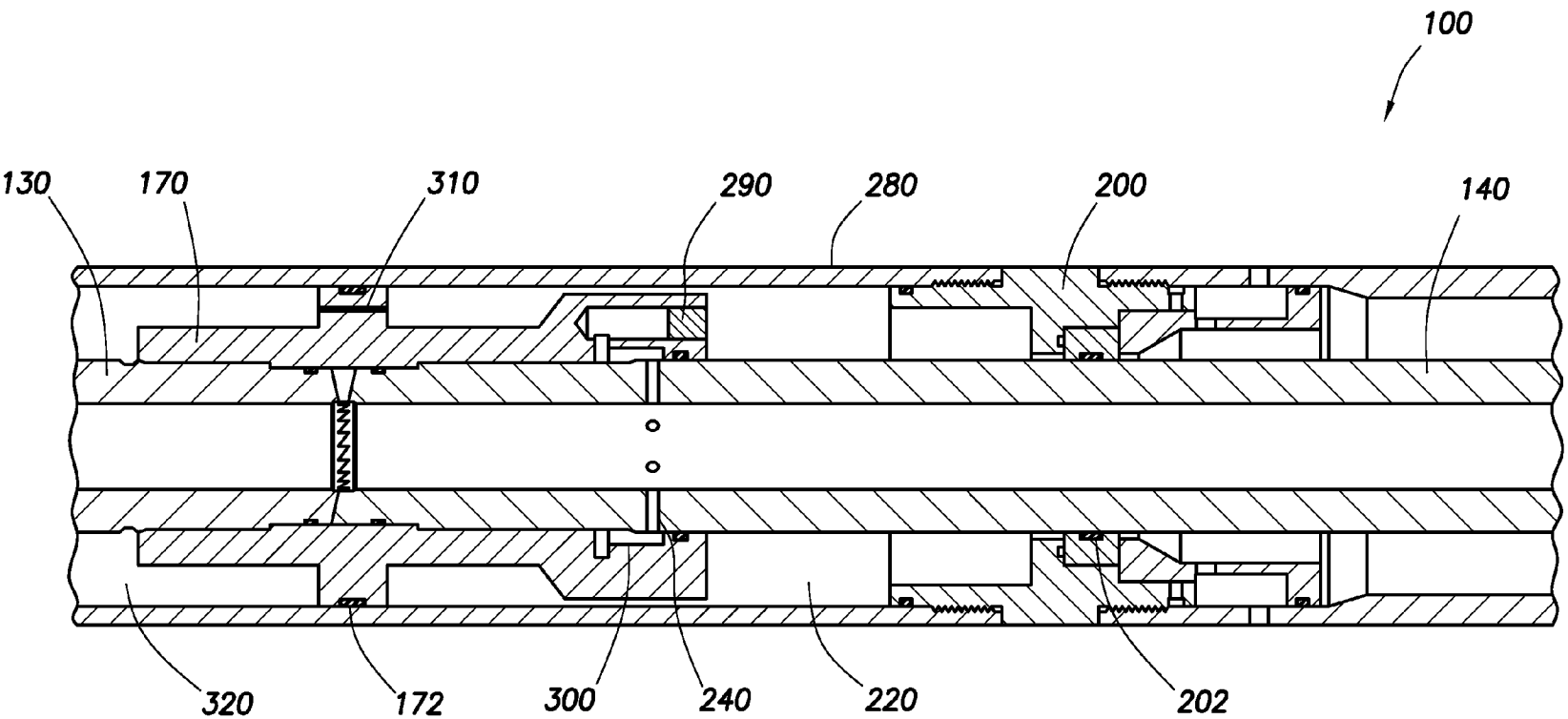
FIG. 2 is a schematic cross-sectional view of a detail of the embodiment of the setting tool shown in FIG. 1.

FIG. 2 is a schematic cross-sectional view of Detail A of the embodiment of the setting tool 100 shown in FIG. 1*b*. As is apparent from FIG. 2, the annulus 220 is bounded by mandrel 140, tool housing 280, piston 200 and coupling 170. A contact surface of the coupling 170 and the tool housing 280 may be sealed by an O-ring 172, and a contact surface of the piston 200 and the mandrel 140 may be sealed by an O-ring 202. In addition, at least one pressurization port 240, and alternatively, a plurality of pressurization ports 240 may provide a path of fluid communication between an interior of the mandrel 140 and the annulus 220, via which path the annulus 220 may be pressurized.

In an embodiment, in order to avoid premature application of liner hanger expansion forces to the piston 200, a valve, e.g., a rupture disk 290, may be positioned between outer ends of the pressurization ports 240 and the annulus 220. In so doing, a valve annulus 300 may be formed, which is bounded by the mandrel 140, the coupling 170 and the rupture disk 290. The valve annulus 300 is in fluid communication with the interior of the mandrel 140 via pressurization ports 240, and a path of fluid communication from the valve annulus 300 to the annulus 220 is blocked by the rupture disk 290. The rupture disk 290 may be designed to fail at a differential pressure greater than a differential pressure to which the rupture disk 290 would be exposed during cementing of the liner, release of a cementing plug or circulation of drilling fluids. For example, the rupture disk 290 may be designed to fail at a differential pressure of about 4000 psi to about 9000 psi. In this manner, the piston 200 is not subjected to the pressure in the mandrel 140 until the liner hanger 120 is ready to be expanded.

In an embodiment, the coupling 170 may include a vent hole 310, which extends through the coupling 170, from the annulus 220 to a further annulus 320 partially defined by mandrel 130, coupling 170 and tool housing 280. The annulus 320 may be exposed to an ambient wellbore pressure as the setting tool 100 is lowered into the wellbore. Therefore, the vent hole 310 may allow the ambient wellbore pressure, which may reach levels of 30,000 psi or greater, to be bled into the annulus 220, thereby preventing the tool housing 280 from collapsing at annulus 220 as the setting tool 100 is lowered into the wellbore.

In operation, the setting tool 100, the liner hanger 120 and the attached liner are lowered into the wellbore to a position at which the liner hanger 120 is to be attached. In an embodiment, the mandrels 110, 130, 140, 150, 190 and the annulus 320 may be exposed to the ambient wellbore pressure, so fluid at the ambient wellbore pressure may bleed through the vent hole 310 into the annulus 220. When the liner hanger 120 is to be expanded, a fluid may be pumped down the mandrels 110, 130, 140, 150, 190 at a pressure greater than the ambient wellbore pressure. At a mandrel pressure of about 3000 psi to about 9000 psi greater than ambient, the rupture disk 290 will burst, thereby allowing pressurized fluid from the mandrel 140 to enter the annulus 220 and apply a force to the piston 200. The force may cause the piston 200 and the tool housing 280 to move downhole with respect to the mandrels 130, 140 and force the expansion cones 270 through the liner hanger 120. In addition, since a diameter of the pressurization ports 240 may be about 1 times to about 10 times greater than a diameter of the vent hole 310, any fluid loss through the vent hole 310 during the pressurization of annulus 220 and the displacement of the piston 200 may easily be compensated for by fluid pumps that pressurize the mandrels 130, 140.

Figure 3:
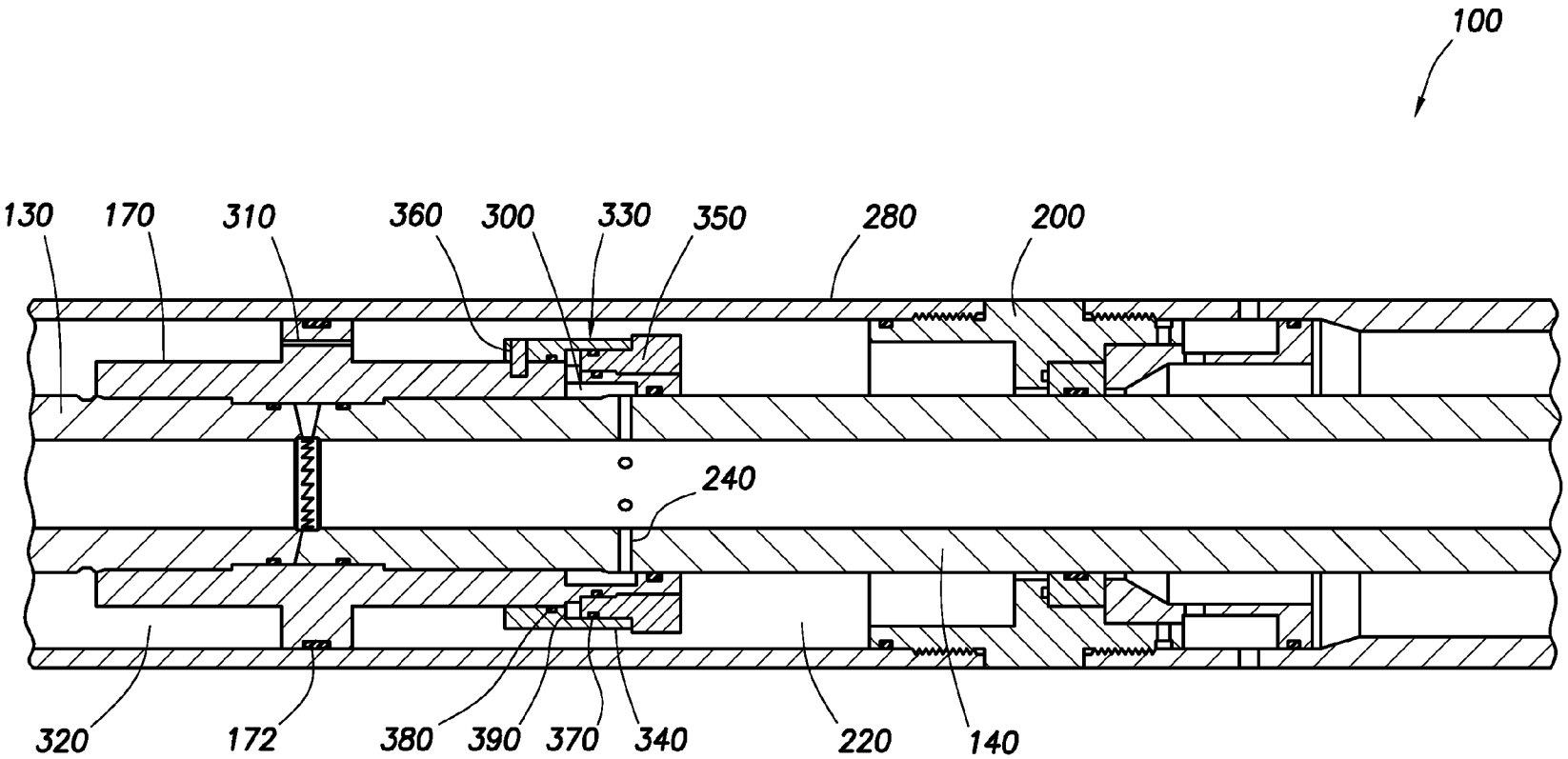
FIG. 3 is a schematic cross-sectional view of a further embodiment of a setting tool.

FIG. 3 is a schematic cross-sectional view of a further embodiment of the setting tool 100. The present embodiment of setting tool 100 differs from the embodiment shown in FIG. 2 in that a piston-type valve 330 is used to isolate the fluid pressure in the mandrel 140 from the annulus 220 until the liner hanger 120 is to be expanded. In an embodiment, the piston-type valve 330 may comprise a valve piston 340; a plug 350, with which the valve piston 340 may mate, and which may be rigidly attached to the coupling 170; and a shear screw 360, which may releasably fix the valve piston 340 in position with respect to the coupling 170 and the plug 350. A mating surface of the valve piston 340 and the plug 350 may be sealed by an O-ring 370, and the valve piston 340 may be sealed with respect to the coupling 170 by a further O-ring 380.

Figure 4:
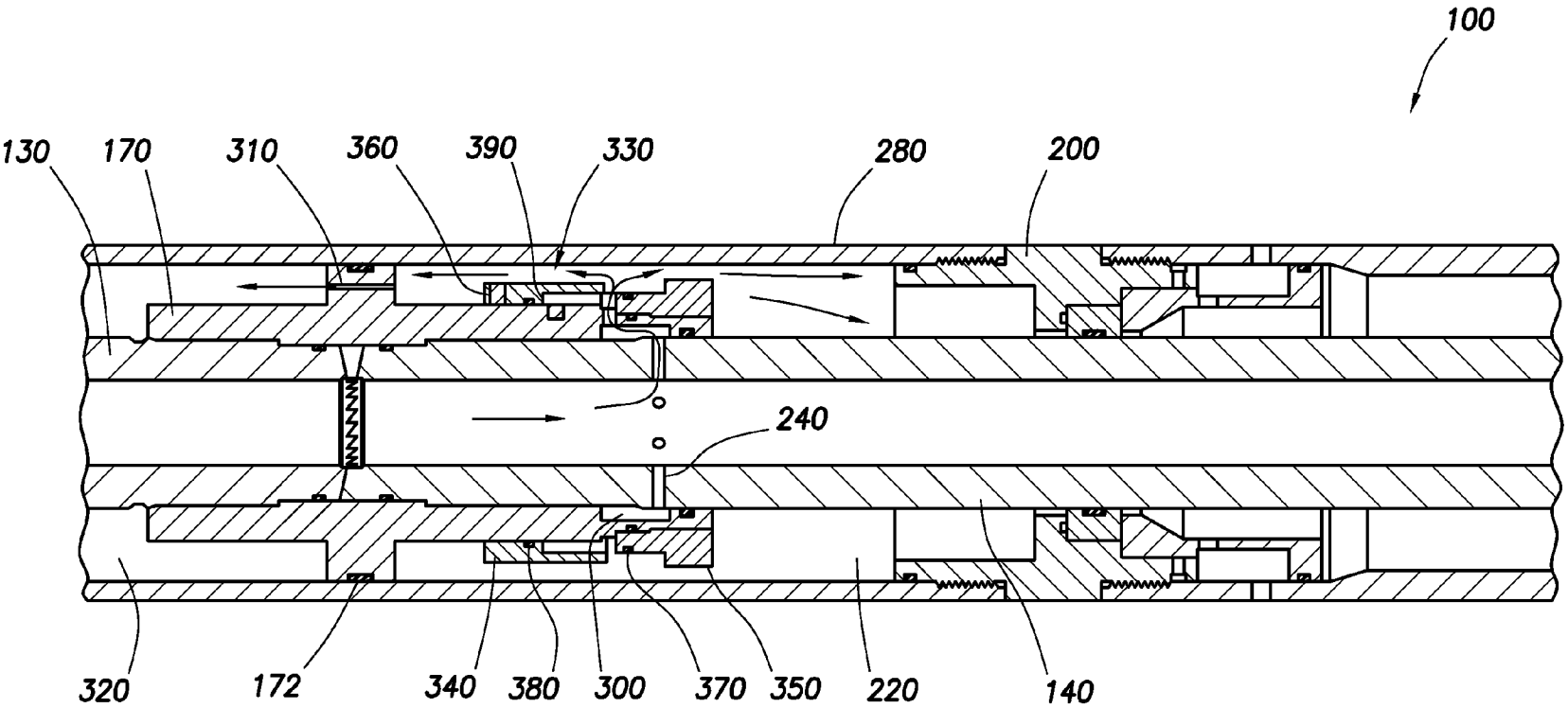
FIG. 4 is a schematic cross-sectional view of the setting tool embodiment of FIG. 3, after a piston-type valve has been opened.

In operation, pressure between the annulus 320 and the annulus 220 may again be equalized via the vent hole 310, as the setting tool 100 is lowered into the wellbore. When the liner hanger 120 is to be expanded, the mandrel 140 may be pressurized, and fluid from the mandrel 140 may travel through the pressurization ports 240 into the valve annulus 300 and exert a longitudinal force on a shoulder 390 of the valve piston 340. When a force applied by the pressurized fluid in the mandrel 140 to the shoulder 390 of the valve piston 340 is sufficient to overcome a shear strength of the shear screw 360, the shear screw 360 breaks and the valve piston 340 is forced uphole with respect to coupling 170 and out of engagement with plug 350, thereby allowing fluid in the mandrel 140 to enter the annulus 220, exert pressure on the piston 200 and force the piston 200 downhole. FIG. 4 illustrates the embodiment of the setting tool 100 of FIG. 3 after the shear screw 360 has been sheared and the valve piston 340 has been forced away from the plug 350. In addition, as in the embodiment of FIG. 2, any fluid lost through the vent hole 310 during the pressurization of annulus 220 and the displacement of the piston 200 may be compensated for by the fluid pumps that pressurize the mandrels 130, 140.

Figure 5:
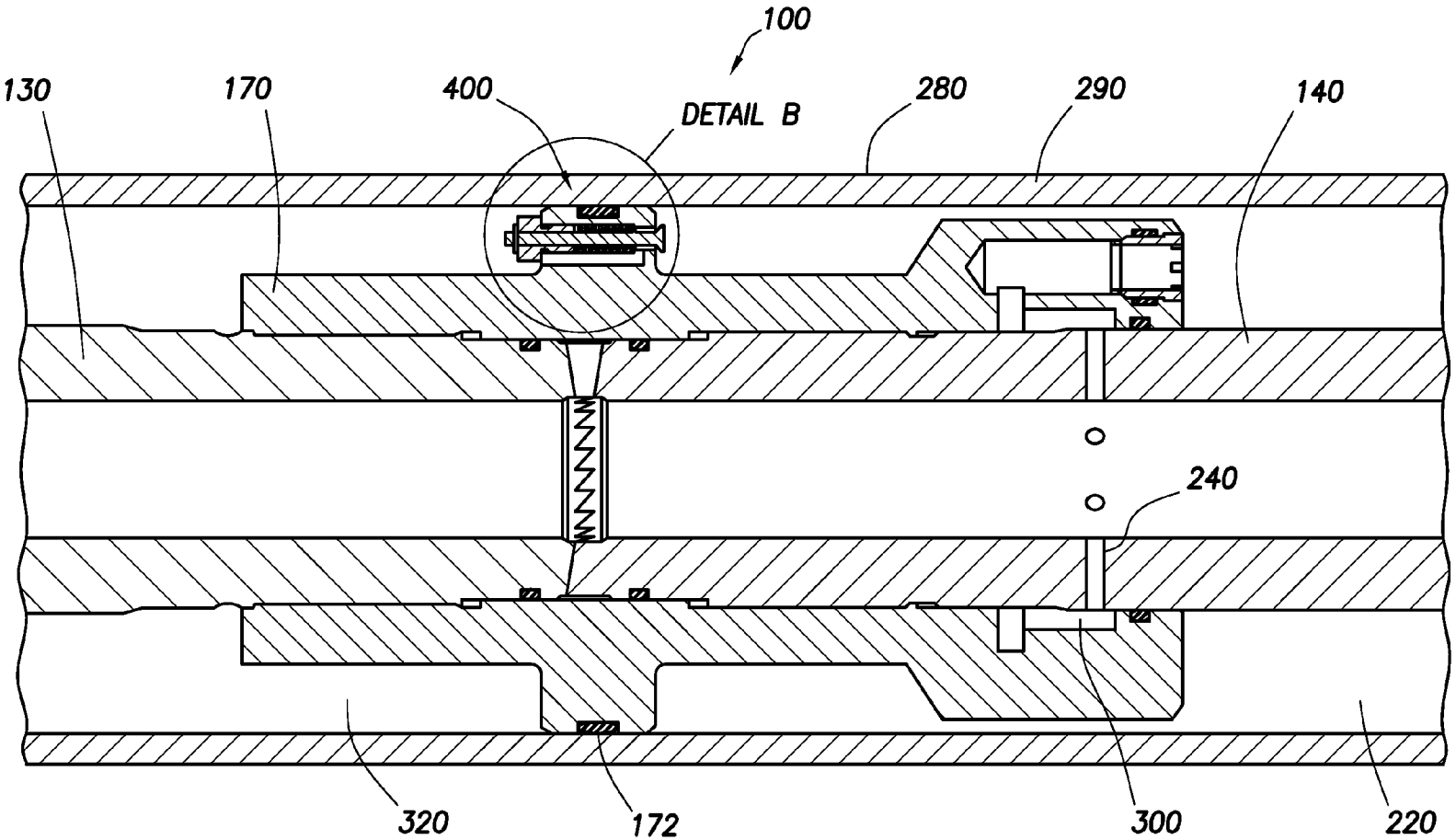
FIG. 5 is a schematic cross-sectional view of a further embodiment of a setting tool.
Figure 6:
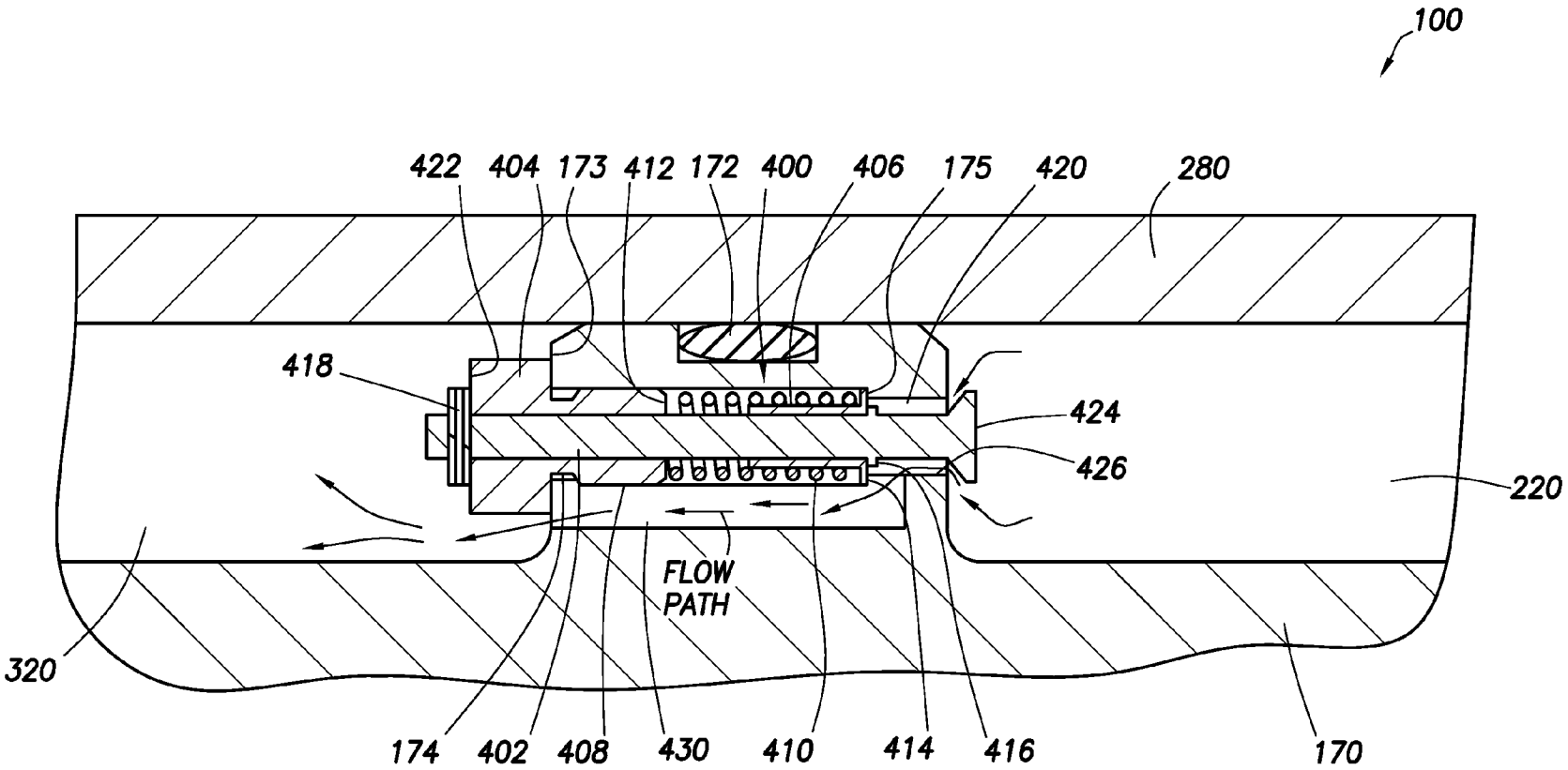
FIG. 6 is a schematic cross-sectional view of a detail of the embodiment of the setting tool shown in FIG. 5.

FIG. 5 is a schematic cross-sectional view of a further embodiment of the setting tool 100. The embodiment of FIG. 5 differs from that of FIG. 2 in that a velocity valve 400 is used in place of the vent hole 310. As is apparent from FIG. 5 and the detail of the velocity valve 400 illustrated in FIG. 6, the velocity valve 400 may be situated in coupling 170, in a path of fluid communication between annulus 220 and annulus 320. In an embodiment, the velocity valve 400 may comprise a valve stem 402, which is supported in a longitudinal through-hole 420 of the coupling 170 by a plug 404 and a sleeve 406. In an embodiment, a downhole portion of the plug 404 may be situated in the longitudinal through-hole 420, and an uphole portion of the plug 404 may be situated outside of the through-hole 420 and may rest against an uphole-side end face 173 of the coupling 170. The plug 404 may be positively fixed in position in the through-hole 420 and with respect to the coupling 170 by a lip 174. In addition, the plug 404 may include a through-hole 408, inside which the valve stem 402 may move longitudinally with respect to the plug 404. In an embodiment, the plug 404 may be made of a metal, metal alloy, composite material, high-strength plastic, or other material able to withstand high temperatures and pressures and a corrosive environment present in a wellbore. In an embodiment, the plug 404 may be extruded or molded or press-fit into the through-hole 420 or fixed in the through-hole 420 in another suitable manner known to one skilled in the art. In an embodiment, the plug 404 may be comprised of steel material and may threadingly engage with the through-hole 420.

In an embodiment, a spring 410 may be biased between a downhole-side end face 412 of the plug 404 and a flange 414, which is situated at a downhole-side end of the sleeve 406 and, in a neutral position of the velocity valve 400, rests against a shoulder 175 of the coupling 170. In addition, the valve stem 402 may be held in the sleeve 406 and the plug 404 by a valve stem flange 416, which abuts against the flange 414 of the sleeve 406, and a retaining ring 418, which, in the neutral position of the velocity valve 400, may rest against an uphole-side end face 422 of the plug 404.

In an embodiment, when the velocity valve 400 is in the neutral position, i.e., when no longitudinal force is applied in an uphole direction to a valve head 424 of the valve stem 402 or a longitudinal force less than a force applied to sleeve 406 by spring 410 is applied in an uphole direction to valve head 424, the velocity valve 400 is configured to be open, i.e., the valve head 424 is not seated on a valve seat 426, and fluid may flow between annuli 220, 320 via a bypass hole 430, which is in fluid communication with through-hole 420 and runs generally parallel to the through-hole 420.

In operation, since the neutral position of the velocity valve 400 is an open position, as the setting tool 100 is lowered into the wellbore, pressure between the annulus 320 and the annulus 220 may be equalized in a manner similar to the setting tool embodiments of FIGS. 2 and 3, via a flow of fluid from annulus 320 to annulus 220. In addition, as is the case with the setting tool embodiment of FIG. 2, when the liner hanger 120 is to be expanded, fluid may be pumped down the mandrels 110, 130, 140, 150, 190 at a pressure sufficient to break the rupture disk 290. When the rupture disk 290 fails, fluid in the mandrel 140 may enter the annulus 220 via valve annulus 300, exert pressure on the piston 200 and force the piston 200 downhole.

In an embodiment, as the annulus 220 is pressurized, fluid from the annulus 220 may initially flow past the valve head 424, into through-hole 420, through bypass hole 430 and into annulus 320. However, in contrast to the setting tool embodiments of FIGS. 2 and 3 that comprise vent hole 310, when a pressure drop from annulus 220 to annulus 320 increases such that a force exerted on valve head 424 by the fluid in annulus 220 is greater than a sum of a force applied to sleeve 406 by spring 410 and a force applied to an uphole-side end of valve stem 402 and retaining ring 418 by fluid in annulus 320, the valve stem 402 is forced in a direction of annulus 320 until valve head 424 lands on the valve seat 426, and the flow of fluid from annulus 220 to annulus 320 is interrupted. Furthermore, since the velocity valve 400 may be closed during and after expansion of the liner hanger 120, the present embodiment of the setting tool 100 may be used to pressure-test the liner.

Figure 7:
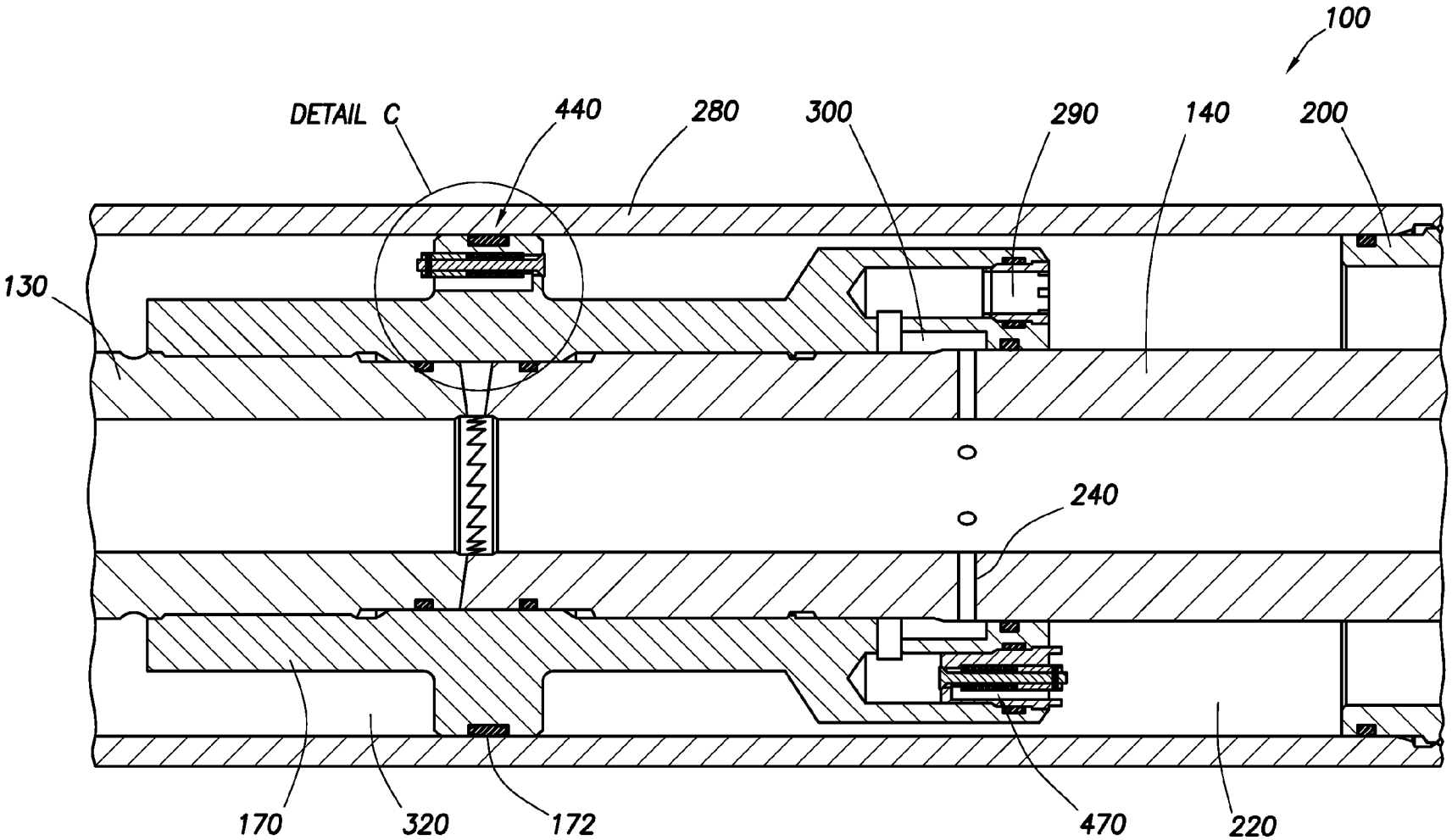
FIG. 7 is a schematic cross-sectional view of a further embodiment of a setting tool.

FIG. 7 is a schematic cross-sectional view of a further embodiment of the setting tool 100. The embodiment of the setting tool 100 of FIG. 7 differs from the embodiment illustrated in FIG. 2 in that the vent hole 310 is replaced by a spring-loaded check valve 440, which is situated in the coupling 170, in a path of fluid communication between annulus 220 and annulus 320. In addition, a second spring-loaded check valve 470 is situated in the coupling 170, in a path of fluid communication between the annulus 220 and the interior of the mandrel 140. The spring-loaded check valve 440 may be oriented such that the valve 440 opens in response to a positive pressure differential from the annulus 320 to the annulus 220 and remains closed in response to a positive pressure differential from the annulus 220 and the annulus 320. In addition, the spring-loaded check valve 470 may be oriented such that it opens in response to a positive pressure differential from the annulus 220 to the interior of the mandrel 140 and remains closed in response to a positive pressure differential from the interior of the mandrel 140 to the annulus 220.

Figure 8:
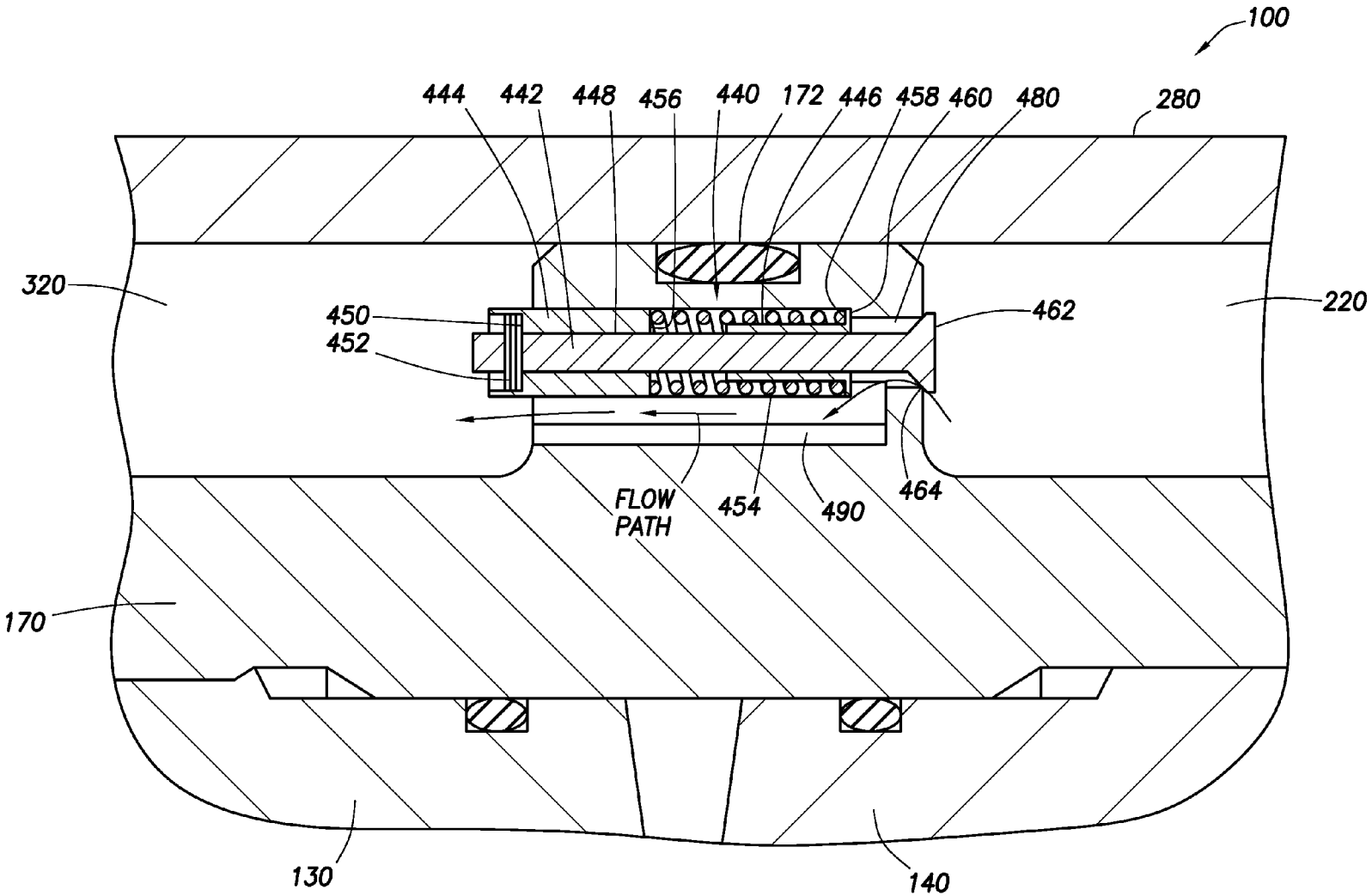
FIG. 8 is a schematic cross-sectional view of a detail of the embodiment of the setting tool shown in FIG. 7.

In an embodiment, the spring-loaded check valve 440, of which a detail is shown in FIG. 8, may comprise a valve stem 442, which is supported in a longitudinal through-hole 480 in coupling 170 by a hollow, cylindrical dog 444 and a sleeve 446. The coupling 170 may include a bypass hole 490, which is in fluid communication with the through-hole 480 and runs generally parallel to the through-hole 480. The dog 444 includes a through-bore 448, in which a portion of the valve stem 442 is situated, as well as a circular seat 450, in which a retaining ring 452 rigidly fixed to the valve stem 442 is seated.

In an embodiment, a spring 454 is biased between a downhole end face 456 of the dog 444 and a flange 458, which constitutes a downhole end of the sleeve 446 and rests against a shoulder 460 formed in the coupling 170. In addition, the spring-loaded check valve 440 is configured such that in a neutral state of the valve 440, i.e., when no longitudinal forces are acting on an uphole-side end of the valve stem 442, the retaining ring 452 and the dog 444 and on an uphole-side end face of a valve head 462 of the valve stem 442 via bypass hole 490, or a sum of longitudinal forces acting on the uphole-side end of the valve stem 442, the retaining ring 452 and the dog 444 and on the uphole-side end face of valve head 462 via bypass hole 490 is less than a sum of a force exerted by spring 454 on dog 444 and a force exerted on a downhole-side end face of valve head 462 by a fluid in annulus 220, the spring-loaded check valve 440 is in a closed state, i.e., the force exerted by the spring 454 pushes the dog 444, the retaining ring 452 and the valve stem 442 uphole, and the force exerted by the fluid in annulus 220 on valve head 462 pushes the valve stem 442 uphole, until the valve head 462 rests against a valve seat 464 situated at a downhole end of the through-hole 480.

In an embodiment, the second spring-loaded check valve 470 may be substantially identical to spring-loaded check valve 440 and may be configured to be closed in a neutral state of the valve 470.

In operation, as in the other embodiments of the setting tool 100 illustrated in FIG. 2, FIG. 3, FIG. 4, FIG. 5 and FIG. 6, the interior of the mandrels 130, 140 and the annulus 320 are exposed to an ambient wellbore pressure as the setting tool 100 is lowered into the wellbore. Accordingly, since the pressure in the annulus 320 and the interior of the mandrel 140 increases with increasing depth of the setting tool 100 and the spring-loaded check valves 440, 470 and the rupture disk 290 are initially all closed, a positive pressure differential develops from annulus 320 to annulus 220 and from the interior of the mandrel 140 to annulus 220. If this positive pressure differential were to become too large, the tool housing 280 would collapse and destroy the setting tool 100. However, as is evident from FIG. 8, if the pressure in annulus 320 increases such that a total force applied by a pressurized fluid in annulus 320 to uphole side ends of the valve stem 442 and the dog 444, as well as to the uphole-side end of the valve head 462 via bypass hole 490, becomes greater than the combined forces of the spring 454 on the dog 444 and the pressurized fluid in annulus 220 on a downhole-side end of the valve head 462, then the valve stem 442 and the dog 444 are forced downhole, thereby lifting valve head 462 off the valve seat 464 and allowing fluid from annulus 320 to bleed into annulus 220 via bypass hole 490. In an embodiment, the spring-loaded check valve 440 is configured to open in response to a positive pressure differential from annulus 320 to annulus 220 ranging from about 1 psi to about 5000 psi.

Conversely, If the setting tool 100 needs to be reversed up the wellbore or up and out of the wellbore, or if the setting tool 100 passes through a region in which the ambient wellbore pressure decreases sharply, a positive pressure differential may develop from the annulus 220 to the interior of the mandrel 140 and to the annulus 320. If this positive pressure differential becomes too great, it could conceivably damage the rupture disk 290 and/or the tool housing 280 and/or pose a risk to personnel handling the setting tool 100 outside of the wellbore. Accordingly, in an embodiment, if the positive pressure differential from the annulus 220 to the interior of the mandrel 140 exceeds a threshold value ranging from about 1 psi to about 5000 psi, the spring-loaded check valve 470 opens to allow pressurized fluid from the annulus 220 to bleed into the interior of the mandrel 140.

In further regard to the operation of the embodiment of the setting tool 100 illustrated in FIG. 7 and FIG. 8, as in the setting tool embodiments of FIG. 2, FIG. 3, FIG. 4 and FIG. 5, when the liner hanger 120 is to be expanded, fluid may be pumped down the mandrels 110, 130, 140, 150, 190 at a pressure sufficient to break the rupture disk 290. When the rupture disk 290 fails, fluid in the mandrel 140 may enter the annulus 220 via valve annulus 300, exert pressure on the piston 200 and force the piston 200 downhole. However, in contrast to the setting tool embodiments of FIG. 2 and FIG. 5, the spring-loaded check valves 440, 470 remain closed during pressurization of the annulus 220, and therefore, no pressurized fluid from the annulus 220 bleeds into the annulus 320.

Figure 9:
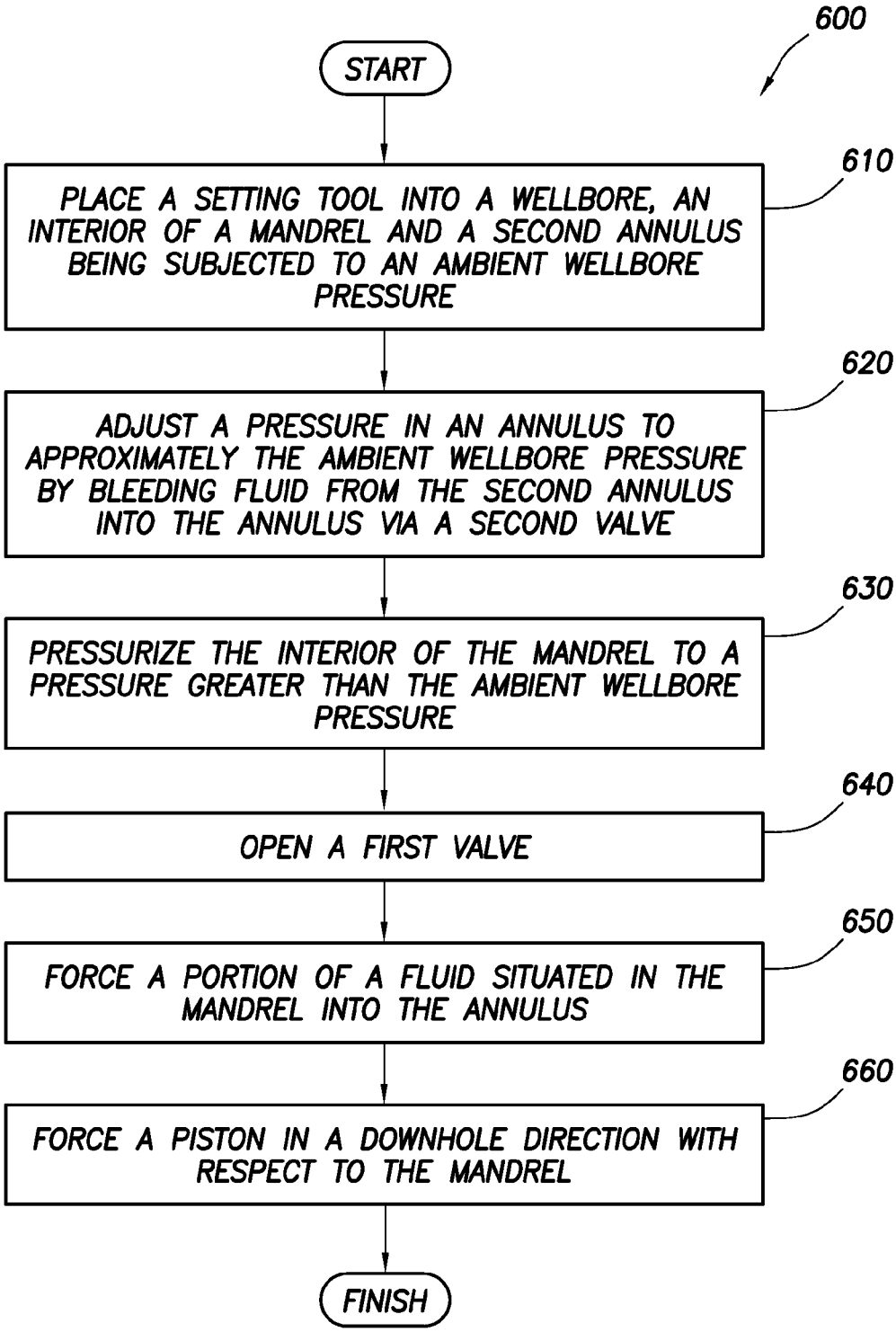
FIG. 9 is a flow chart of a method for setting a liner hanger in a wellbore.

Turning now to FIG. 9, a method 600 for setting a liner hanger in a wellbore is described. The setting tool comprises a tool housing, a mandrel, a piston, a collar, a first valve and a second valve. The tool housing, the mandrel, the piston and the collar define an annulus. The tool housing and the collar partially define a second annulus. The first valve is situated between an interior of the mandrel and the annulus. The second valve is situated in the collar, between the annulus and the second annulus.

At block 610, the setting tool is placed into the wellbore, whereby an interior of the mandrel and the second annulus is subjected to an ambient wellbore pressure. At block 620, a pressure in the annulus is adjusted to approximately the ambient wellbore pressure by bleeding fluid from the second annulus into the annulus via the second valve. At block 630, the interior of the mandrel is pressurized to a pressure greater than the ambient wellbore pressure. At block 640, the first valve is opened. At block 650, a portion of a fluid situated in the mandrel is forced into the annulus. At block 660, the piston is forced in a downhole direction with respect to the mandrel.

While embodiments of the invention have been shown and described, modifications thereof can be made by one skilled in the art without departing from the spirit and teachings of the invention. The embodiments described herein are exemplary only, and are not intended to be limiting. Many variations and modifications of the invention disclosed herein are possible and are within the scope of the invention. For example, the techniques described above may be applied to a fraction of the piston subassemblies and still obtain a force multiplying effect and/or force aggregation effect with those particular piston subassemblies. For example, if the techniques are applied to 3 piston subassemblies of a string of 6 piston subassemblies, the force generated by the three piston subassemblies collectively may be said to multiply the force of one piston subassembly three times or to aggregate the force generated by each of the three piston subassemblies, thereby reducing the force needed to be produced by one of these three piston subassemblies to expand the subject liner hanger. For example, in the embodiment of the setting tool 100 illustrated in FIG. 3, the vent hole 310 may be replaced with a velocity valve or a spring-loaded check valve. In addition, in the embodiments of the setting tool 100 illustrated in FIG. 2, FIG. 5 and FIG. 7, an additional rupture disk may be connected between the pressurization ports 240 and the annulus 220 as a redundancy, in case one of the rupture disks fails to burst at a desired pressure differential. Furthermore, in an embodiment, a rupture disk or a piston-type valve may be utilized with an additional piston or pistons. Furthermore, the setting tool 100 may be designed for setting tools and/or subassemblies other than liner hangers, for example for setting packers.

Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R_L$, and an upper limit, $R_U$, is disclosed, any number falling within the range is specifically disclosed. In particular, the following numbers within the range are specifically disclosed: $R=R_L+k*(R_U-R_L)$, wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim is intended to mean that the subject element is required, or alternatively, is not required.

Both alternatives are intended to be within the scope of the claim. Use of broader terms such as comprises, includes, having, etc. should be understood to provide support for narrower terms such as consisting of, consisting essentially of, comprised substantially of, etc.

Accordingly, the scope of protection is not limited by the description set out above but is only limited by the claims which follow, that scope including all equivalents of the subject matter of the claims. Each and every claim is incorporated into the specification as an embodiment of the present invention. Thus, the claims are a further description and are an addition to the embodiments of the present invention.

I claim:

1. A downhole setting tool, comprising;

a tool housing;

a hollow mandrel situated in the tool housing;

a piston situated between the mandrel and the tool housing;

a collar situated between the mandrel and the tool housing, wherein the tool housing, the mandrel, the piston and the collar define an annulus; and a first valve that, in a closed position, blocks a path of fluid communication between the interior of the mandrel and the annulus, wherein the first valve comprises a valve piston and a plug configured to mate with the valve piston.

2. The downhole setting tool of claim 1, wherein the downhole setting tool is configured to one of set a packer or set a liner hanger.

3. The downhole setting tool of claim 1, further comprising a second valve situated in the collar between the annulus and a second annulus partially defined by the collar and the tool housing.

4. The downhole setting tool of claim 3, wherein the second valve comprises a velocity valve that assumes an open position when a pressure in the annulus is approximately equal to a pressure in the second annulus.

5. The downhole setting tool of claim 4, wherein the velocity valve is configured to close when the pressure in the annulus is greater than the pressure in the second annulus by a threshold value.

6. The downhole setting tool of claim 3, wherein the second valve comprises a spring-loaded check valve.

7. The downhole setting tool of claim 6, wherein the spring-loaded check valve is configured to open when a pressure in the second annulus is greater than a pressure in the annulus by a threshold value.

8. The downhole setting tool of claim 6, wherein the mandrel has a transverse hole that runs from an interior of the mandrel to an exterior of the mandrel, further comprising a second spring-loaded check valve situated at the end of the transverse hole, wherein, in a closed position, the second spring-loaded check valve blocks the path of fluid communication between the interior of the mandrel and the annulus via the transverse hole.

9. The downhole setting tool of claim 8, wherein the second spring-loaded check valve is configured to open when a pressure in the annulus is greater than a pressure in the mandrel by a threshold value.

10. A downhole setting tool, comprising;

a tool housing;

a hollow mandrel having at least one transverse hole that runs from an interior of the mandrel to an exterior of the mandrel, the mandrel being situated in the tool housing;

a piston situated between the mandrel and the tool housing;

a collar situated between the mandrel and the tool housing, wherein the tool housing, the mandrel, the piston and the collar define an annulus; and a valve situated in the collar, between the annulus and a second annulus partially defined by the collar and the tool housing, wherein the valve comprises a spring-loaded check valve.

11. The downhole setting tool of claim 10, further comprising a second valve situated at an end of the at least one transverse hole, wherein in a closed position, the second valve blocks a path of fluid communication between the interior of the mandrel and the annulus via the at least one transverse hole, wherein the second valve comprises a rupture disk.

12. The downhole setting tool of claim 10, further comprising a second valve situated at an end of the at least one transverse hole, wherein in a closed position, the second valve blocks a path of fluid communication between the interior of the mandrel and the annulus via the at least one transverse hole, wherein the second valve comprises a valve piston.

13. The downhole setting tool of claim 10, further comprising a second valve situated at an end of the at least one transverse hole, wherein in a closed position, the second valve blocks a path of fluid communication between the interior of the mandrel and the annulus via the at least one transverse hole.

14. The downhole setting tool of claim 13, wherein the second valve comprises a valve piston.

15. The downhole setting tool of claim 14, wherein the second valve further comprises a plug configured to mate with the valve piston.

16. A method of setting a liner hanger in a wellbore using a downhole setting tool, the method comprising:

providing a downhole setting tool comprising a tool housing, a mandrel, a piston, and a collar, wherein the tool housing, the mandrel, the piston, and the collar define a first annulus, wherein the tool housing, the mandrel, and the collar partially define a second annulus;

placing the downhole setting tool into the wellbore, the interior of the mandrel and the second annulus being subjected to an ambient wellbore pressure as the downhole setting tool is placed into the wellbore;

adjusting a pressure in the first annulus to approximately the ambient wellbore pressure by bleeding fluid from the second annulus into the first annulus via a first valve situated in the collar, between the first annulus and the second annulus;

pressurizing the interior of the mandrel to a pressure greater than the ambient wellbore pressure;

opening a second valve situated between an interior of the mandrel and the first annulus;

forcing a portion of a fluid situated in the mandrel into the first annulus; and forcing the piston in a downhole direction with respect to the mandrel.

17. The method of claim 16, wherein adjusting a pressure in the first annulus to approximately the ambient wellbore pressure comprises forcing the first valve from a closed position into an open position.

18. The method of claim 17, further comprising after adjusting a pressure in the first annulus to approximately the ambient wellbore pressure, closing the first valve.

19. The method of claim 16, further comprising after forcing a portion of a fluid situated in the mandrel into the first annulus, bleeding a portion of a fluid situated in the first annulus into the second annulus via the first valve.

20. The method of claim 19, further comprising after bleeding a portion of a fluid situated in the first annulus into the second annulus via the first valve, closing the first valve.

* * * * *